US006928743B1

(12) United States Patent
Marshall

(10) Patent No.: US 6,928,743 B1
(45) Date of Patent: Aug. 16, 2005

(54) SIDING INSTALLATION TOOL

(76) Inventor: Gary Marshall, 1719 E. Main St., Vermillion, SD (US) 57069

( * ) Notice: Subject to any disclaimer, the term of this patent is extended or adjusted under 35 U.S.C. 154(b) by 25 days.

(21) Appl. No.: 10/638,158

(22) Filed: Aug. 8, 2003

(51) Int. Cl.[7] ..... G01D 21/00
(52) U.S. Cl. ..... 33/648; 52/748.11; 52/DIG. 1
(58) Field of Search ..... 52/748.11, 748.1, 52/747.11, 747.1, 749.11, 749.12, DIG. 1; 33/648, 649, 646, 647

(56) References Cited

U.S. PATENT DOCUMENTS 298,682 A * 5/1884 Finch ..... 33/647
738,256 A 9/1903 Tinklepaugh
780,697 A 1/1905 Adams
1,035,062 A 8/1912 Vroome
1,192,651 A 7/1916 Leonard
4,056,889 A 11/1977 Barnett, III
4,141,452 A * 2/1979 Martin et al. ..... 211/70.6
4,183,144 A 1/1980 Barnett, III
4,541,217 A 9/1985 Stewart
4,656,755 A 4/1987 Birnel et al.
5,018,279 A 5/1991 Williams
D338,635 S 8/1993 Spindler et al.
5,542,226 A 8/1996 Markovich
5,692,311 A * 12/1997 Paquin ..... 33/647
6,470,642 B1 10/2002 Eads

* cited by examiner

*Primary Examiner*—Naoko Slack
(74) *Attorney, Agent, or Firm*—Leonard & Proehl, Prof. LLC

(57) ABSTRACT

A siding installation tool for support pieces of siding and act as a guide to facilitate consistent alignment of the siding being installed includes a clamp assembly coupled to an extendable guide assembly. The clamp assembly is lockable to a piece of siding and the guide assembly is adjustably extendable from the clamp assembly to support a second piece of siding for installation.

20 Claims, 3 Drawing Sheets

SIDING INSTALLATION TOOL

BACKGROUND OF THE INVENTION

1. Field of the Invention

The present invention relates to building tools and more particularly pertains to a new siding installation tool for support pieces of siding and act as a guide to facilitate consistent alignment of the siding being installed.

2. Description of the Prior Art

The use of building tools is known in the prior art. U.S. Pat. No. 5,692,311 issued Dec. 2, 1997 to Paquin describes a multiple piece clamp and jig apparatus that requires separate placement of the clamp and jig. Further, the clamp and jig are held together only by the clamping action of the clamp. Another type of building tool is U.S. Pat. No. 780,697 issued Jan. 24, 1905 to Adams disclosing a shingle gage and holder using a clamp having triangular teeth and a board fixedly attached to the clamp. U.S. Pat. No. 4,056,889 issued Nov. 8, 1977 to Barnett, III discloses a single elongated strip shingle alignment fixture. U.S. Pat. No. 5,018,279 issued May 28, 1991 to Williams discloses another single elongated strip shingle alignment tool. U.S. Pat. No. 4,183,144 issued Jan. 15, 1980 to Barnett, III discloses still another single elongated strip shingle alignment apparatus. U.S. Pat. No. 738,256 issued Sep. 8, 1903 to Tinklepaugh discloses a non-clamping shingle gage. U.S. Pat. No. 1,192,651 issued Jul. 25, 1916 to Leonard discloses a multiple member shingling gage system. U.S. Pat. No. 4,541,217 issued Sep. 17, 1985 to Stewart discloses a double row shingle alignment fixture. U.S. Pat. No. 1,035,062 issued Aug. 6, 1912 to Vroome discloses a line holder used for aligning shingles and marking parallel lines. U.S. Pat. No. 6,470,642 issued Oct. 29, 2002 to Eads discloses a self-sealing shingle mounting system. U.S. Pat. No. 4,656,755 issued Apr. 14, 1987 to Birnel et al. discloses a carpet banding capper. U.S. Pat. No. 5,542,226 issued Aug. 6, 1996 to Markovich discloses a roofer's grid apparatus. U.S. Pat. Design No. 338,635 issued Aug. 24, 1993 to Spindler et al. discloses an ornamental appearance for a shingle placement guide.

While these devices fulfill their respective, particular objectives and requirements, the need remains for a device that remains in one piece and can be clamped firmly onto a piece of siding to facilitate installation of the siding.

SUMMARY OF THE INVENTION

The present invention meets the needs presented above by providing a siding installation tool having a clamp assembly coupled to an extendable guide assembly.

An object of the present invention is to provide a new siding installation tool that attaches firmly to an installed piece of siding and provides a guide for installation of the next overlapping piece of siding.

Another object of the present invention is to provide a new siding installation tool that locks into place yet can be easily and quickly removed as desired.

Still another object of the present invention is to provide a new siding installation tool that reduces the number of man hours required for installation of siding.

Yet another object of the present invention is to provide a new siding installation tool that makes it possible for a single person to install siding.

To this end, the present invention generally comprises a siding installation tool having a clamp assembly coupled to an extendable guide assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
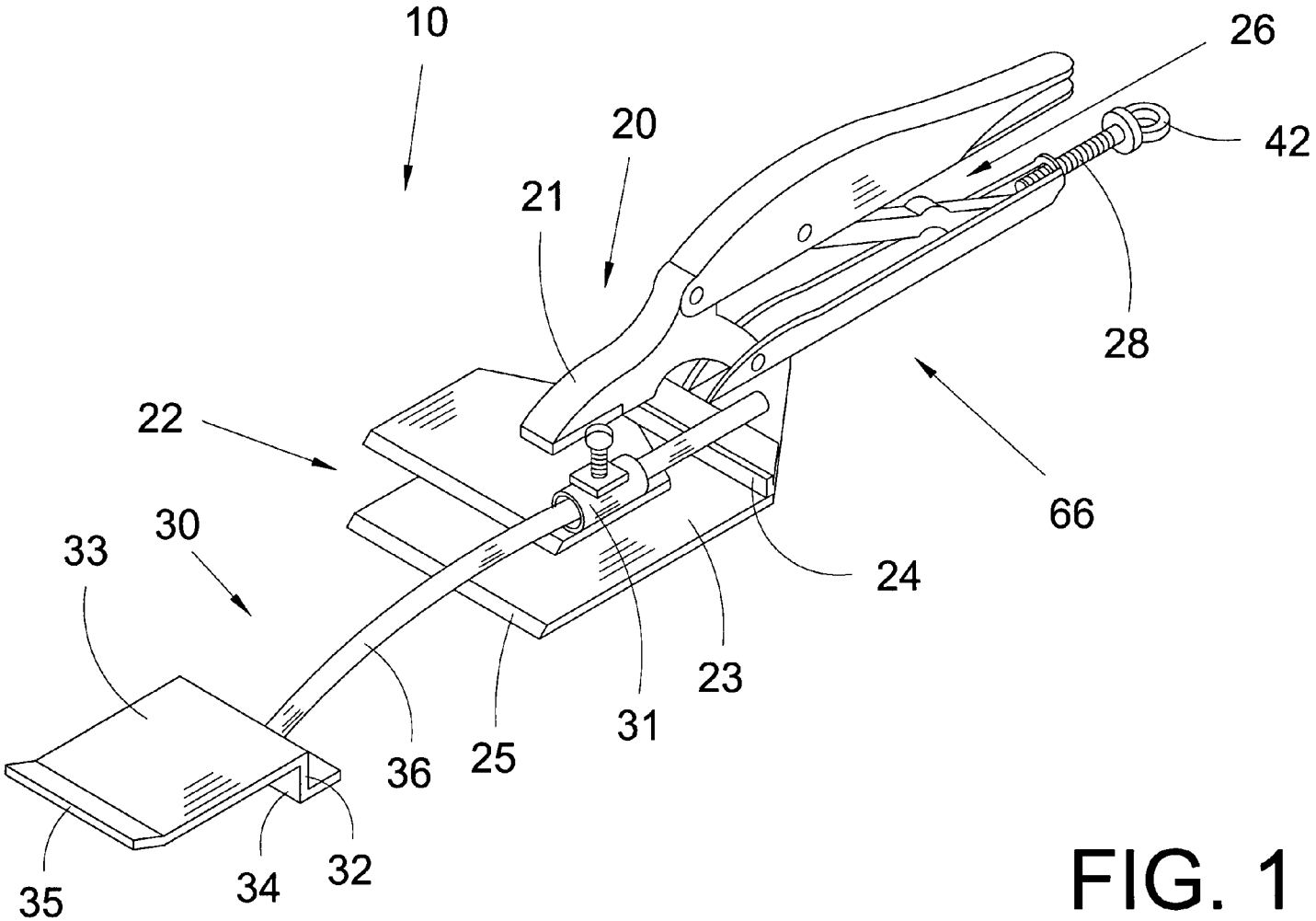
FIG. 1 is a perspective view of a new siding installation tool according to the present invention.
Figure 2:
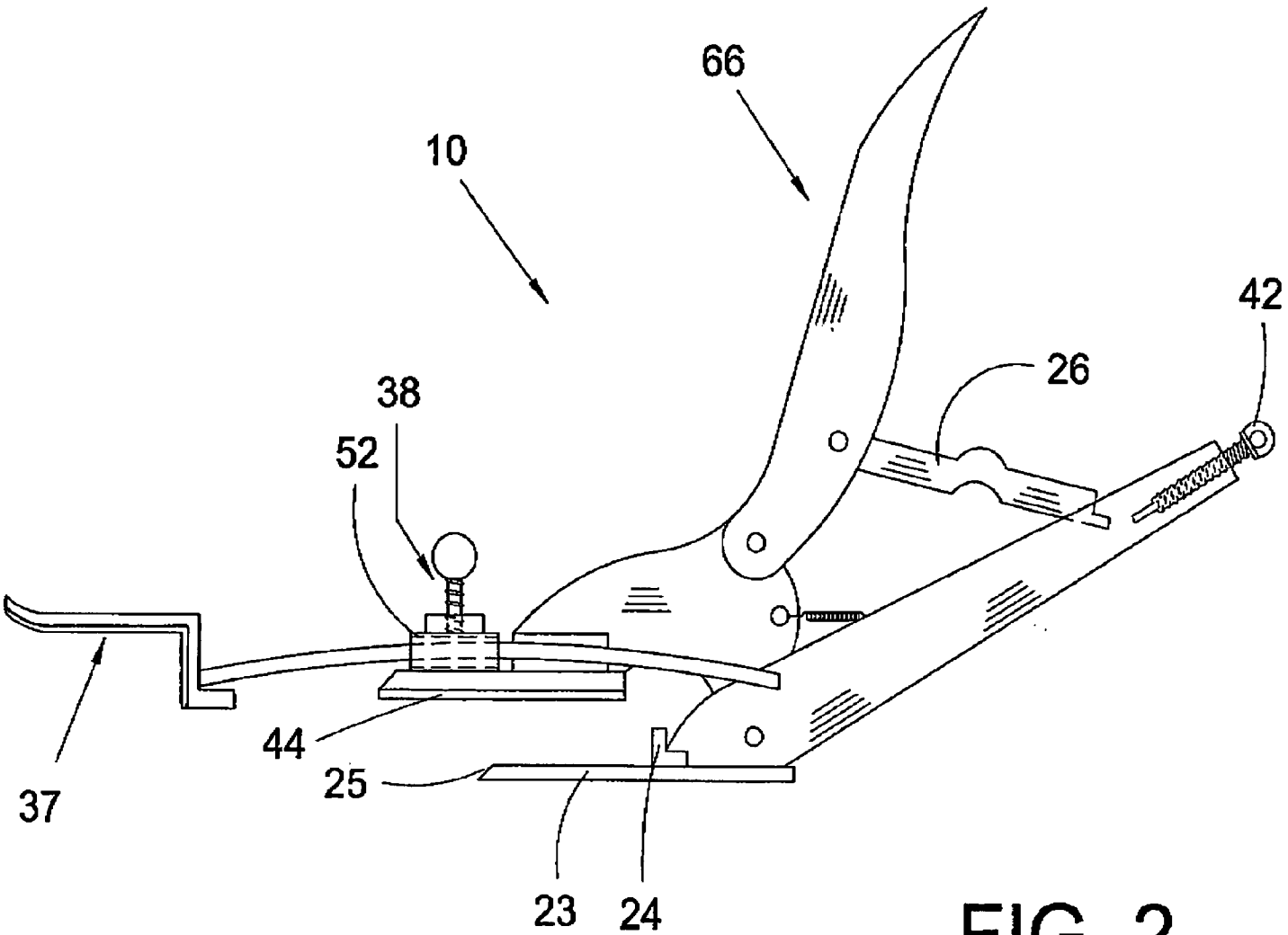
FIG. 2 is a side view of the present invention in an open position.
Figure 3:
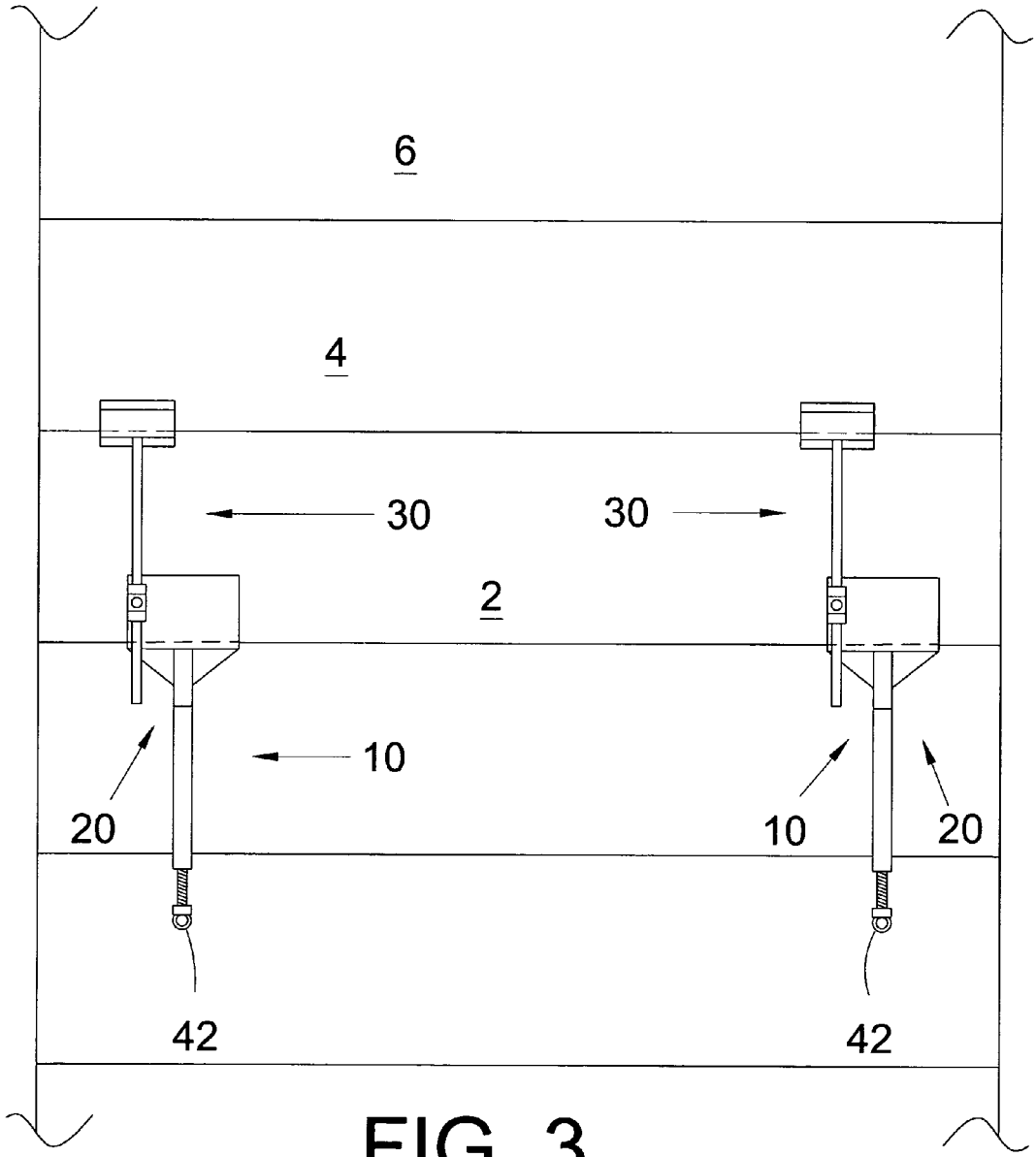
FIG. 3 is a perspective view of the present invention in use.

With reference now to the drawings, and in particular to FIGS. 1 through 3 thereof, a new siding installation tool embodying the principles and concepts of the present invention and generally designated by the reference numeral 10 will be described.

As best illustrated in FIGS. 1 through 3, the siding installation tool 10 generally comprises a clamp assembly 20 having closable jaws 22. The clamp assembly is designed for coupling to a first piece of siding 2. A guide assembly 30 is provided having a support member 32. The support member 32 has a bearing portion 34. Thus, the support member 32 is designed for supporting a second piece of siding 4 adjacent to the first piece of siding 2 when the clamp assembly 20 is coupled to the first piece of siding 2. The guide assembly 30 is slidably coupled to the clamp assembly 20 such that the support member 32 is positionable at a selectable distance from the clamp assembly 20. This permits a user to establish a consistent desired amount of overlap between the first and second pieces of siding.

The clamp assembly 20 includes a stop plate 24 coupled to one of the jaws 22 for abutting the first piece of siding 2 to facilitate consistent placement of the first piece of siding 2 between the jaws 22.

The clamp assembly 20 has a locking assembly 26 for locking the jaws 22 in place as in vise grip pliers. The locking assembly 26 is adjustable for setting a distance between the jaws 22 when the clamp assembly 20 is in a closed position. The locking assembly 26 includes a screw member 28 for adjusting the distance between the jaws 22 when the clamp assembly 20 is in the closed position. In an embodiment, an annular member 42 is coupled to the clamp assembly 20. Thus, the clamp assembly 20 is designed for being hung from the annular member 42. The annular member 42 is preferably coupled to the screw member 28 for facilitating rotating the screw member 28 using tools designed for rotating eye hooks and the like.

To prevent marring of the exposed portions of the siding, at least one of the jaws 22 includes a protective covering material 44 for inhibiting marring of the siding.

The guide assembly 30 includes a collar member 31 coupled to the clamp assembly 20 and an extension member 36 slidably inserted through the collar member 31. The guide assembly 30 also includes a locking means 38 coupled to the collar member 31 for selectively locking the extension member 36 into a static position relative to the collar member 31. The locking means 38 may be a thumbscrew or other conventional mechanism to provide frictional engagement preventing the extension member from moving within the collar 31 during use. Depressions or spaced holes may be provided in the extension member to permit insertion of a rigid member through the extension member to hold it in place.

The support member 32 includes a distal flange 33 extending from the bearing portion 34. Thus, the guide assembly 30 is designed for holding the second piece of siding 4 against a structure 6 while the bearing portion 34 supports the second piece of siding 4. The distal flange 33 has an outwardly flared edge 35 for facilitating insertion of the second piece of siding 4 between the support member 32 and the structure 6.

The jaws 22 include an upper jaw 21 and a lower jaw 23. The lower jaw 23 has a beveled distal edge 25 for facilitating insertion of the lower jaw 23 between the first piece of siding 2 and either the structure 6 or an earlier installed piece of siding.

The distal flange 33 also includes the protective covering material 44 on an interior face 37 of the distal flange 33 for inhibiting marring of the siding.

Development of the invention has shown that the jaws are well constructed when made of iron between 16 and 20 gauge with 18 providing the best combination of stiffness and minimized thickness to permit insertion of the lower jaw 23 under attached pieces of siding. For proper lateral support and easier alignment to keep the jaws 22 straightly attached, the closable jaws 22 each have a width of between 2 and 6 inches with about 3 inches being preferred for providing sufficient stability and reduced manufacturing costs and optimal weight for the device.

In an embodiment, the extension member 36 is arcuate to hold the support member 32 closer to the structure to inhibit formation of gaps between the support member and the structure or siding. Similarly, a conduit 52 extending through the collar 31 receives the extension member 36. In production the conduit may be angled relative to the plane of the upper jaw to which it is typically attached. It is preferred that the conduit 52 is angled relative to the clamp assembly 20 to direct the support member towards the structure during use instead of away from the structure. Thus, the collar is designed for preventing gaps from forming between the support member and an upper portion of the first piece of siding.

The clamp assembly 20 includes a handle portion 66. The handle portion 66 extends away from the closable jaws 22 at an angle between about 35 and 50 degrees for facilitating grasping of the handle portion 66 during use. The angle is also related to the amount of torsion applied to the lower jaw during use as a rearward portion of the lower jaw does not abut the siding when the jaws clamp onto the siding. An angle of about 40 degrees, particularly in combination with either 16 or 18 gauge iron jaws, provides good results.

In use, a first piece of siding is applied to a structure. The siding installation tool is clamped onto the first piece of siding. The stop plate should be positioned firmly against the lower edge of the first piece of siding. Either before or after clamping to the first piece of siding, the guide assembly of the siding installation tool is adjusted to extend the desired distance from a clamp assembly of the siding installation tool. Thus, the support member is positioned to permit insertion of a second piece of siding between the guide assembly and the upper portion of the first piece of siding to provide the desired overlap. The second piece of siding is inserted into and supported by the support member and may be attached to the structure. The process is then repeated moving up the outer face of the structure.

It is particularly useful to employ two siding installation tools that can each be attached to the first piece of siding sufficiently spaced apart to hold the second piece of siding in a stable position. Thus, a single person can apply the siding installation tools, position the second piece of siding, and attach the second piece of siding.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A siding installation guide tool comprising:

a clamp assembly, said clamp assembly having closable jaws whereby said clamp assembly is adapted for coupling to a first piece of siding;

a guide assembly having a support member, said support member having a bearing portion whereby said support member is adapted for supporting a second piece of siding adjacent to the first piece of siding when said clamp assembly is coupled to the first piece of siding, said guide assembly being slidably coupled to said clamp assembly such that said support member is positionable at a selectable distance from said clamp assembly;

wherein said guide assembly includes a collar member coupled to said clamp assembly; and said guide assembly further including an extension member slidably inserted through said collar member.

2. The siding installation guide tool of claim 1 wherein said clamp assembly includes a stop plate coupled to one of said jaws for abutting the first piece of siding to facilitate consistent placement of the first piece of siding between said jaws.

3. The siding installation tool of claim 1 wherein said clamp assembly has a locking assembly for locking said jaws in place.

4. The siding installation tool of claim 3 wherein said locking assembly is adjustable for setting a distance between said jaws when said clamp assembly is in a closed position.

5. The siding installation tool of claim 4 wherein said locking assembly includes a screw member for adjusting said distance between said jaws when said clamp assembly is in said closed position.

6. The siding installation tool of claim 5, further comprising:

an annular member coupled to said clamp assembly whereby said clamp assembly is adapted for being hung from said annular member, said annular member being coupled to said screw member for facilitating rotating said screw member.

7. The siding installation tool of claim 1 further comprising:

an annular member coupled to said clamp assembly whereby said clamp assembly is adapted for being hung from said annular member.

8. The siding installation tool of claim 1 wherein at least one of said jaws includes a protective covering material for inhibiting marring of the first piece of siding.

9. The siding installation tool of claim 1 further comprising:

said guide assembly including a locking means coupled to said collar member for selectively locking said extension member into a static position relative to said collar member.

10. The siding installation tool of claim 1 wherein said support member includes a distal flange extending from said bearing portion whereby said guide assembly is adapted for holding the second piece of siding against a structure while said bearing portion supports the second piece of siding.

11. The siding installation tool of claim 10 wherein said distal flange has an outwardly flared edge for facilitating insertion of the second piece of siding between said support member and the structure.

12. The siding installation tool of claim 10 wherein said distal flange includes a protective covering material on an interior face of said distal flange for inhibiting marring of the second piece of siding.

13. The siding installation tool of claim 1 wherein said jaws include an upper jaw and a lower jaw, said lower jaw having a beveled distal edge for facilitating insertion of said lower jaw between the first piece of siding and a structure.

14. The siding installation tool of claim 1 wherein said extension member is arcuate.

15. The siding installation tool of claim 1 wherein said closable jaws each have a width of about 3 inches.

16. The siding installation tool of claim 1 wherein a conduit extending through said collar receives said extension member, said conduit being angled relative to said clamp assembly whereby said collar is adapted for preventing gaps from forming between said support member and an upper portion of the first piece of siding.

17. The siding installation tool of claim 1 wherein said clamp assembly includes a handle portion, said handle portion extending away from said closable jaws at an angle between about 35 and 50 degrees for facilitating grasping of said handle portion during use.

18. A siding installation guide tool comprising:

a clamp assembly, said clamp assembly having closable jaws whereby said clamp assembly is adapted for coupling to a first piece of siding;

a guide assembly having a support member, said support member having a bearing portion whereby said support member is adapted for supporting a second piece of siding adjacent to the first piece of siding when said clamp assembly is coupled to the first piece of siding, said guide assembly being slidably coupled to said clamp assembly such that said support member is positionable at a selectable distance from said clamp assembly; and wherein said guide assembly includes an extension member slidably mounted to said clamp assembly, said extension member being arcuate.

19. The siding installation tool of claim 18 wherein said extension member arcs toward said closable jaws of said clamp assembly.

20. The siding installation tool of claim 18 wherein said extension member is arcuate in a plane substantially perpendicular to a plane of one of said closable jaws of said clamp assembly.

* * * * *